United States Patent [19]

Duvieusart et al.

[11] Patent Number: 4,869,033

[45] Date of Patent: Sep. 26, 1989

[54] PRESSURIZED FLUID STORAGE TANK

[75] Inventors: Jean-Claude Duvieusart, Lasne; Maximilien Le Begge, Brussels, both of Belgium

[73] Assignee: Compagnie D'Enterprises CFE, Brussels, Belgium

[21] Appl. No.: 114,170

[22] Filed: Oct. 27, 1987

[30] Foreign Application Priority Data

Oct. 30, 1986 [FR] France ..... 86 15162

[51] Int. Cl.[4] ..... E04B 1/32

[52] U.S. Cl. ..... 52/169.6; 52/245; 52/247; 52/283; 220/1 B

[58] Field of Search ..... 52/247, 245, 283, 169.6; 220/1 B

[56] References Cited

U.S. PATENT DOCUMENTS 2,331,483 10/1943 Lawman et al. ..... 220/1 B
2,341,547 2/1944 Heineman ..... 220/1 B
2,531,742 11/1950 Pomyteala ..... 52/245 X
3,151,416 10/1964 Eakin et al. ..... 52/169.6 X
3,672,103 6/1972 Kost ..... 52/169.6 X

*Primary Examiner*—Carl D. Friedman
*Attorney, Agent, or Firm*—Pennie & Edmonds

[57] ABSTRACT

The invention relates to a pressurized fluid storage tank (1) adapted to be disposed underground at a slight depth. The invention comprises a ring (2) forming the side wall of the tank and two horizontal circular walls disposed in said ring and forming respectively the bottom wall (4) and the top wall (9) of the tank (1). Tie rods (8) are disposed between the top wall (9) and the bottom wall (4), these tie rods (8) being adapted to take the stresses resulting from the pressure of the stored fluid on said bottom wall (4) and top wall (9), leakproofing means (10) adapted to make the tank impervious to the fluid stored lining the interior of the tank (1). The tank (1) according to the invention permits storage under excellent conditions of inconspicuousness and safety. The invention is more particularly applicable to the storage of pressurized fuel fluids.

20 Claims, 3 Drawing Sheets

PRESSURIZED FLUID STORAGE TANK

BACKGROUND OF THE INVENTION

1. Field of the invention.

The invention relates to a pressurized fluid storage tank adapted to be installed at a slight depth underground.

The storage tank according to the invention is more particularly applicable to the storage of fuel gas in large quantities.

The use of liquefied gas tanker ships has high-lighted the need to have high capacty tanks available for the storage of pressurized fuel fluids. Tanks of this kind can at one and the same time serve as storage reserves near gas terminals, and as buffers enabling irregularities in the demands on the system to be attenuated.

The form in which the fluid is stored governs to a large extent the technology of the storage tanks.

2. Description of the prior art.

From the technological point of view of distinction is made between low-pressure storage tanks and high-pressure storage tanks.

Gasholders belong to the low-pressure technique. They consist of a dome supported by concentric rings adapted to slide vertically in relation to one another, the whole arrangement, whose volume is variable, being supported by the internal pressure of the gas. Tanks of this kind, which are often additionally supported by an external metallic structure, are inesthetic and, because of their dimensions, constitute easily located targets for ill-intentioned persons.

In cryogenic storage tanks the gas is held in liquid form at very low temperature, thus enabling it to be stored under pressures close to atmospheric pressure.

These cryogenic tanks are protected by a double casing: an outer casing protecting the tank against external agents and a second casing able to hold the liquefied gas and reesistant to very low temperatures (of the order of −40° C. to −160° C.) prevailing in the tank. Between these two casings an insulating material is disposed in order to restrict thermal losses through the tank. Losses of cold through the casing are generally compensated by controlled evaporation of the fluid contained in the tank. The cost of producing these tanks and also the cost of operating them are high.

For high-pressure storage tanks a spherical shape is generally adopted, since the sphere is the technically optimum shape.

However, because of their dimensions the spherical casing and its external reinforcement constitute a prominent feature in a landscape. Like gasholders, these spherical tanks therefore constitute a visual embarrassment and a preferential target for malevolent action. In addition, these tanks are exposed to the direct action of atmospherical agents, such as solar radiation, which may give rise to excessive thermal and mechanical streses in them.

Another way of withstanding the considerable pressure produced by the stored fluid is to place the tanks in a medium which itself exerts a counterpressure on the walls.

This solution is for example applied by excavating deep cavities in clay soil. This material is gastight and the weight of the soil and the pressure of the phreatic water develop the counterpressure which ensures the stability of the tank.

In other types of soil the counterpressure can be exerted by the phreatic water alone; in this case the wall of the underground tank is lined with an impervious covering.

Deep underground storage tanks have the advantage over the other types of tanks mentioned of being inconspicuous and of integrating harmoniously into the environment.

Their disadvantage is above all the high cost of excavation. In addition, the subsoil is not always suitable for the installation of storage tanks of this type.

It has therefore been attempted to produce a type of storage tank which is just as inconspicuous, out of sight and out of reach where malevolent action is concerned as a tank installed at a great depth underground, while nevertheless its operating cost are identical to those of a spherical surface tank.

The aim of the invention is therefore to be able to store pressurized fuel fluids under excellent conditions of reliability.

Another aim of the invention is to effect this storage under good economic conditions.

Yet another aim of the invention is a storage tank of inconspicuous shape and adapted to be covered by a mound or buried at a shallow depth.

SUMMARY OF THE INVENTION

The present invention relates to a pressurized fluid storage tank comprising:

- a ring forming the side wall of the tank,
- a bottom wall of circular shape disposed in the bottom part of the ring,
- a top wall of circular shape disposed in the top part of the ring,
- tie rods disposed vertically between the bottom wall and the top wall of the tank, the ends of these tie rods being made fast to the bottom and top walls respectively, and said tie rods being adapted to take the loads produced on the top and bottom walls through the pressure of the stored fluid,
- and leakproofing means adapted to make said tank impervious to the stored fluid.

In one advantageous embodiment the ring is provided at the bottom part of its inside face with a cantilever rib on which the bottom wall is supported peripherally, a watertight seal being interposed between its peripheral part and said rib. In this case the bottom wall is advantageously connected to said rib by means of articulated anchorages adapted to allow slight relative movements between the ring and the bottom wall.

At the top part of its inside face the ring is similarly provided with a cantilever rib against which the top wall bears by the peripheral part of its top face, a watertight seal being interposed between this peripheral part and said rib.

In one particular embodiment the bottom end of the ring is bevelled on its inside face and is provided on its outside face with a portion projecting in relation to the outside surface of the ring, in order to permit its installation by undercutting.

The ring and the bottom and top walls may be made of concrete or of steel.

In one embodiment the ring and the top and bottom walls are made of reinforced concrete and/or of prestressed concrete. It is, in particular, possible to make the ring of prestressed concrete, while the top and bottom walls are made of reinforced concrete.

When the ring and the top and bottom walls are made of concrete, it is generally advantageous or even necessary for the inside surface of the tank to be lined with a material impervious to the fluid stored and compatible with said fluid.

This lining may in particular be of metal, and in that case it is provided with an expansion gusset in the zone where the ring and the top wall meet.

This leaktight lining may also be made of a material selected from the plastomers and elastomers.

It will be understood that the material used to make the lining will depend on the type of fluid to be stored in the tank.

When the ring and the bottom and top walls are made of steel, the tank can be made leaktight by means of a leaktight lining in the zone where the ring and the bottom wall meet and in the zone where the ring and the top wall meet.

The tie rods which are disposed vertically between the bottom wall and the top wall may in particular consist of steel beams (such as H beams), whose ends are provided with anchoring base plates. Tie rods of this type can equally well be used when the walls of the tank are made of steel as when they are made of concrete. In the latter case the anchoring base plates of the tie rods are embedded in the concrete forming the to and bottom walls.

However, when the walls of the tank are made of concrete, the tie rods may also consist of prestressed concrete pillars.

The advantages of the tank according to the invention consist in that the gas can be stored under conditions of inconspicuousness and safety similar to those of a storage tank situated at a great depth, while the cost of production is considerably less.

The tank according to the invention can be constructed independently of the quality, the homogeneity and the mechanical characteristics of the ground. In addition to the advantages mentioned above, it will be noted that the storage tank according to the invention can be constructed on the site with the aid of simple well-tried construction techniques and economically.

Another advantage of the invention is that, since the tank is underground, it has the benefit of excellent isothermal conditions which to a great extent are independent of external climatic factors.

Another advantage consist in that the tank can be completely constructed at ground level and be lowered into position by undercutting; according to another method of construction the tank is installed in situ after the undercutting of the ring forming the side wall. The amount of excavation is thus reduced to the strict minimum and the area of land required to be taken over is therefore limited.

The tank can also be constructed by conventional methods, such as open excavtion between banks or with the protection of a sheet-pile wall.

The tank according to the invention also permits a considerable saving of space. Once the installation has been completed, the surface of the ground above the tank can be used for any purpose. Even the construction of a building can be contemplated, since the pressure exerted on the ground by a building cannot affect the tank.

Finally, the tank according to the invention is insensitive to subsequent lowering of ground water levels, which is not the case with tanks installed deep underground.

Despite its great capacity, the tank according to the invention is therefore inconspicuously integrated into the landscape and puts the stored fluid beyond the reach of ill-intentioned persons and of accidents of external origin, such as impacts and explosions.

BRIEF DESCRIPTION OF THE INVENTION

Other features and advantages of the invention will emerge from the description of one particular embodiment which is given below with reference to the accompanying drawings, and and in which.

DETAILED DESCRIPTION

Figure 1:
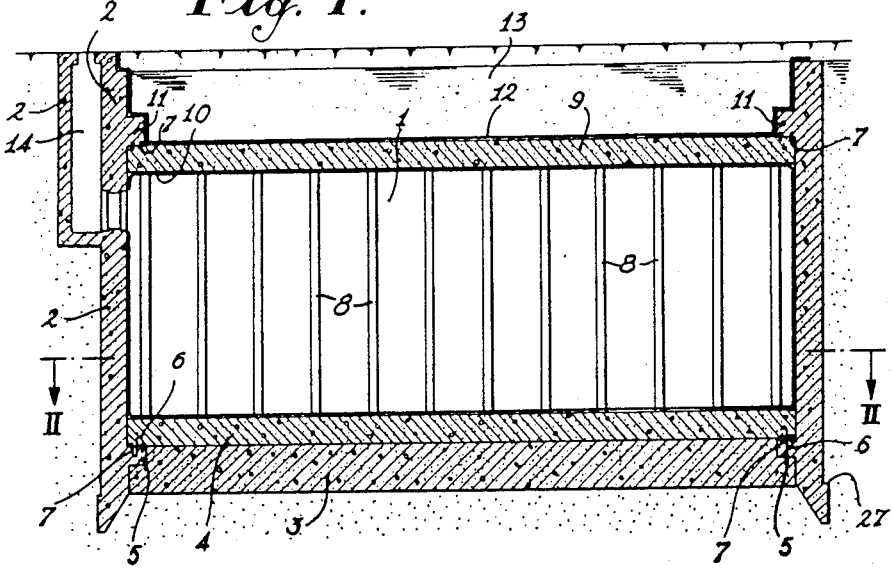
FIG. 1 is a view in section on a vertical plane passing through the axis of a tank according to the invention.

FIG. 1 is a view in section taken on a vertical plane passing through the axis of an underground reinforced concrete tank according to the invention.

The side wall of the tank 1 consists of a ring 2 of prestressed reinforced concrete.

The foundations of the tank 1 consist of a layer of ballast concrete 3 which distributes the pressure over the ground and stabilizes the structure.

The bottom wall 4 of reinforced concrete is cast onto this ballast concrete 3. On it is periphery this bottom wall 4 rests on a cantilever rib 5 extending around the ring 2. An articulated anchorage 6 fastens the ring 2 and the bottom wall 4 together.

A double seal 7 forms an effective barrier against the infiltration of water.

Tie rods 8, the number of which depends on the dimensions of the tank, are described in greater detail in connection with FIG. 3. These tie rods 8 join together the bottom wall 4 and the top wall 9. The bottom end of these tie rods 8 is embedded in the bottom wall 4; the top end of these tie rods 8 is embedded in the top wall 9.

Figure 5:
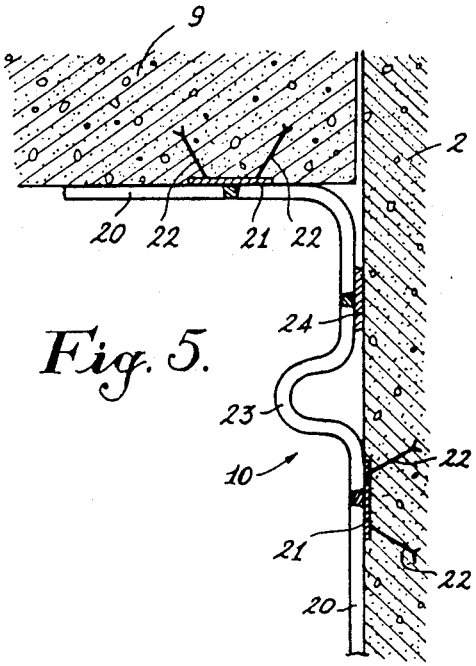
FIG. 5 is a side view in section of a constructional detail of the lining of a reinforced concrete tank according to the invention.

A lining 10 impervious to the fluid stored covers the inside face of the tank 1, as can be seen in greater detail in FIG. 5.

The periphery of the top wall 9 is inserted under a cantilever rib 11 extending around the ring 2. The double seal 7 prevents and infiltration of water between the rib 11 and the top wall 9.

A sealing covering 12 covers the top of the tank 1, that is to say the outer face of the top wall 9, the rib 11, and the top fringe of the ring 2. The tank 1 is covered by a backfill 13.

An access shaft 14 is provided at the side of the side wall of the ring 2 and permits access to the interior of the tank 1. The tank 1 is connected to the distribution system by connection means (not shown) according to a well-known technique.

Figure 2:
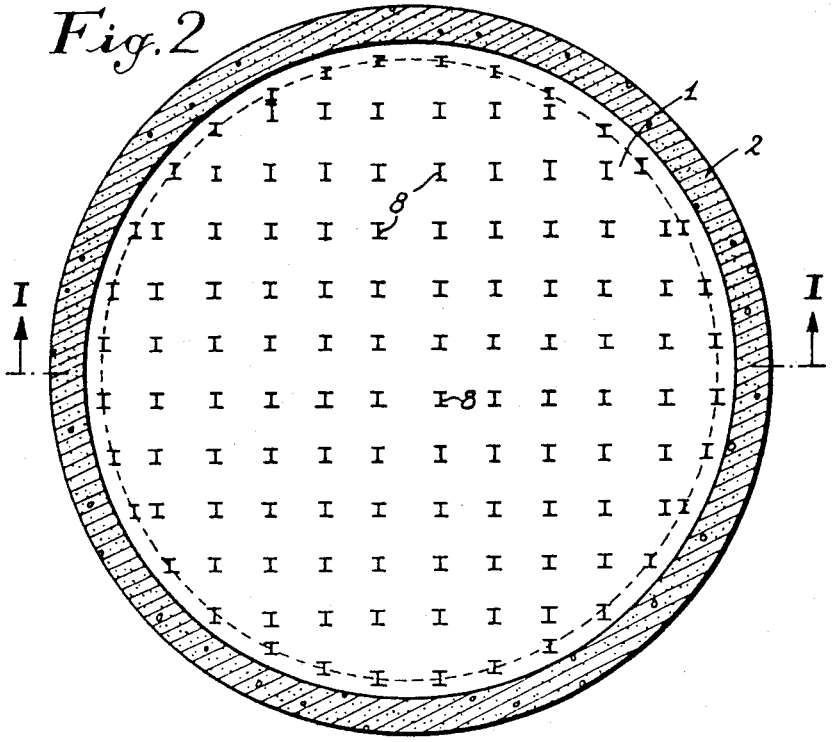
FIG. 2 is a view in section on a horizontal plane II—II of a tank according to the invention.

FIG. 2 is a view in section of the tank taken on a horizontal plane represented by the line II—II in FIG. 1.

Each of the small crosses represents a tie rod 8, the arrangement of these tie rods 8 being indicated solely by way of example.

A series of tie rods 8 are disposed vertically in line with the ribs 5 and 11, the other tie rods being distributed regularly over the whole of the walls 4 and 9 in such a manner as to take stresses homogeneouslly.

Figure 3:
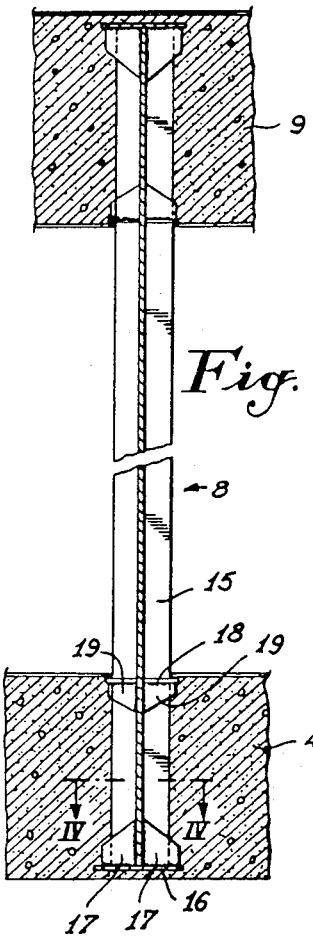
FIG. 3 is a side view in section, partly broken away, of a metal tie rod.

FIG. 3 is a side view of a tie rod 8 in the tank 1 according to the invention. The tie rod 8 shown consists of a steel H beam 15; at the end of this beam 15 an anchorage base plate 16 is fixed, being disposed at right angles to said beam. Two attached trapezoidal members 17, disposed respectively at right angles to the base plate 16 and the median portion of the beam 15, reinforce the connection between the beam 15 and its base plate 16.

The end of the beam 15, together with its base plate 16, is embedded in the concrete of the bottom wall 4. A second base plate 18 is fixed on the beam 15 at the height of the top face of the wall 4. Two attached members 19 hold this base plate 18 at right angles to the tie rods 8. The plates 20 forming the leaktight lining 10 of the tank 1 are fixed, in the present instance by welding, to said second base plate 18 in such a manner as to form a continuous casing. The top end of the tie rod 8 is anchored in the top wall 9 in identical manner.

Figure 4:
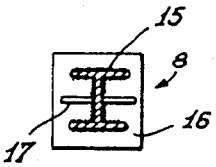
FIG. 4 is a view in section on a horizontal plane IV—IV of a metal tie rod.

FIG. 4 is a viw in section on the line IV—IV in FIG. 3 of a metal tie rod 8 of the tank 1, showing the shape of the anchorage base plate 16 and the H-profile of the beam 15.

FIG. 5 is a view in section of a constructional detail of the lining of a reinforced concrete tank 1 according to the invention. The edge of the lining plates 20 on the inside face of the ring 2 and of the lining plates 20 on the inside face of the top wall 9 is fixed to flat bars 21 fastened by spikes 22 to said walls. These flat bars 21 constitute support lines for the lining 10. At the corner formed between the ring 2 and the top wall 9 an expansion gusset 23 connects these two support lines, thus at one and the same time ensuring the continuity of the lining 10 and permitting relative movement of the lining 10 in relation to each of the walls (2 and 9).

A shoe 24 is disposed between the lining 10 and the surface of the ring 2. This shoe 24 lowers the coefficient of friction of the lining 10 in relation to the surface of the ring 2 and prevents wear due to the relative movements of these two parts.

FIGS. 6 to 10 are schematic views in section of a method of construction of the tank 1 according to the invention.

Figure 6:
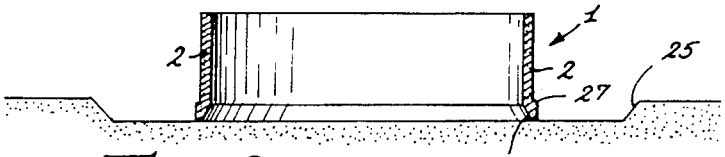
FIGS. 6 to 10 are schematic sectional views of different stages in the construction of a tank by undercutting.

FIG. 6 shows the first stage of construction of the ring 2 constituting the side wall. The construction site is cleared and leveled by pre-excavation of a depression 25.

The bottom part of the ring 2 is constructed on site with the aid of from work and is prestressed.

The bottom end of the ring 2 is bevelled on its inside face to form a cutting edge 26 facilitating the installation of the structure by undercutting.

The bottom end of the ring 2 also has on its outer face a portion 27 projecting beyond the outer surface of the remainder of the ring 2. In relation to this projection 27 the remainder of the outer surface of the ring 2 is thus of reduced diameter, so as to form between the outer face of the ring 2 and the ground an annular gap 28. During the undercutting a fluid, such as bentonite, is pumped into this gap 28 to reduce friction between the outer face and the ground and thus to limit the force required to install the structure in position.

Figure 7:
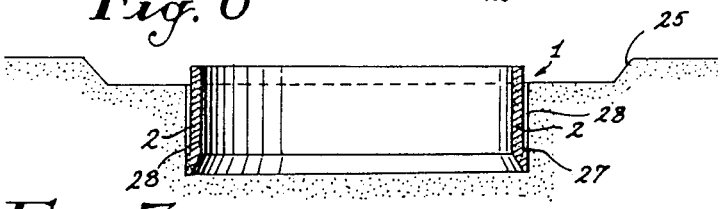

FIG. 7 is a schematic sectional view of the bottom part of the ring 2 after the first stage of installation by undercutting.

The surface of the site bounded by the ring 2 having been progressively excavated, the ring 2 gradually drives into the ground, the excavation being propped up by the ring 2 itself.

Figure 8:
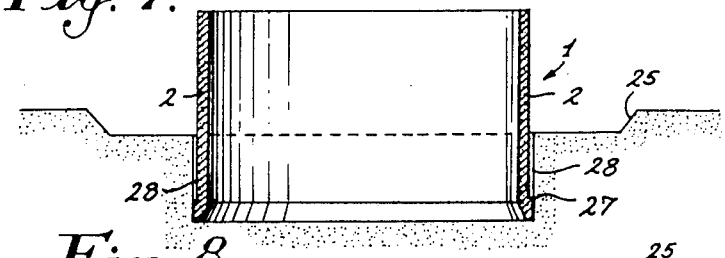

FIG. 8 is a schematic sectional view of the ring 2 after erection of its top part. Installation in position of the complete ring 2 is then continued by undercutting.

Figure 9:
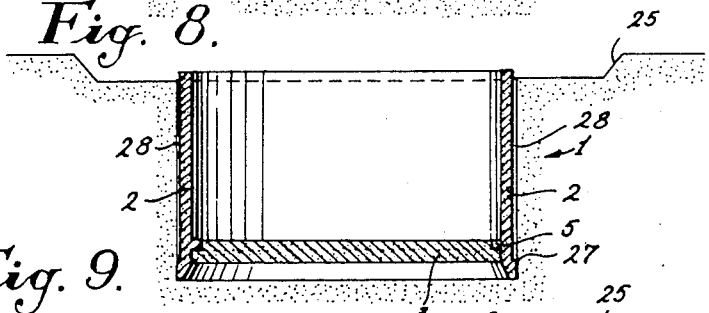

FIG. 9 is a schematic sectional view of the ring 2 when it has reached its final installation level. Foundations for the future tank 1 are formed by ballast concrete 3. A first cantilever rib 5, intended to support the bottom wall 4 at its periphery, is then cast.

Figure 10:
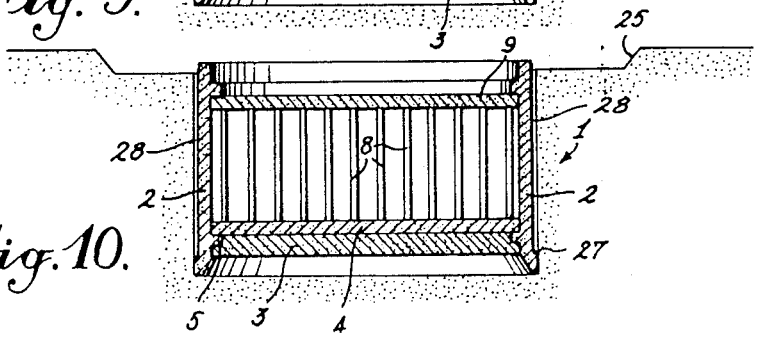

FIG. 10 is a schematic sectional view of the tank 1 after the bottom wall 4, the top wall 9, and the tie rods 8 have been placed in position.

The operations take place as follows. The reinforcement for the bottom wall 4 and the metal tie rods 8 are placed in position. Concrete is poured for the bottom wall 4, thus fastning said bottom wall 4 to the bottom ends of the tie rods 8. The leaktight lining 10 of the bottom wall 4 and of the ring 2 is then placed in position. Formwork is installed for the top wall 9, and the lining of the top wall 9 is placed in position. Finally, the reinforcement is laid and concrete poured for the top wall 9, whereupon the sealing cover 12 is laid in position and covered with backfill 13.

The example of embodiment described above relates more particularly to a tank 1 made of concrete.

The tie rods 8 consist in this case either of metal sections or of prestressed concrete pillars.

As stated previously, the tank according to the invention may also be made of steel.

In this case the tie rods 8 are also of steel. When the tank is of steel, it is generally not necessary to install a leaktight lining 10. However, curved sheets are provided to form the joints between the side wall and the bottom and top walls respectively.

As an example, a storage tank can be constructed with a diameter of the order of 35 meters and an inside height of the order of some ten meters, for the storage at ground temperature, that is to say about 10° C., of 10,000 cubic meters of propane gas at a pressure of 8 bars.

We claim:

1. A tank (1) for storing pressurized fluid, which comprises:

a ring (2) forming the side wall of the tank (1), a bottom wall (4) of circular shape disposed in the bottom part of the ring (2), a top wall (9) of circular shape disposed in the top part of the ring (2), tie rods (8) disposed vertically between the bottom wall (4) and the top wall (9) of the tank (1), the ends of said tie rods (8) being made fast to the bottom wall (4) and top wall (9) respectively, and said tie rods (8) being adapted to take the loads produced on the bottom wall (4) and top wall (9) through the pressure of the stored fluid, and leak-proofing means (10) adapted to make said tank (10 impervious to the stored fluid, said ring (2) being provided at the bottom part of its inside face with a cantilever rib (5) on which the bottom wall (4) is supported peripherally, a watertight seal (7)

being interposed between its peripheral part and said rib (5).

2. A tank (1) as claimed in claim 1, in which the bottom wall (4) is connected to the rib (5) by means of articulated anchorages (6) adapted to allow slight relative movements between the ring (2) and the bottom wall (4).

3. A tank (1) as claimed in claim 1, in which the ring (2) is provided at the top part of its inside face with a cantilever rib (11) against which the top wall (9) bears by the peripheral part of its top face, a watertight seal (7) being interposed between this peripheral part and said rib (11).

4. A tank (1) as claimed in claim 3, in which the ring (2) and the bottom wall (4) and the top wall (9) are composed of a material selected from reinforced concrete and prestressed concrete, the leakproofing means comprising a lining (10) of the inside surface of the tank (1) with a material impervious to the fluid stored and compatible with said fluid.

5. A tank (1) as claimed in claim 3, in which the ring (2) and the bottom wall (4) and top wall (9) are made of steel, the leakproofing means comprising a lining (10) in the zone where the ring (2) and the bottom wall (4) meet and in the zone where the ring (2) and the top wall (9) meet.

6. A tank (1) as claimed in claim 1, in which the ring (2) is provided at the top part of its inside face with a cantilever rib (11) against which the top wall (9) bears by the peripheral part of its top face, a watertight seal (7) being interposed between this peripheral part and said rib (11).

7. A tank (1) as claimed in claim 1, in which the bottom end of the ring (2) is bevelled on its inside face so as to form a cutting edge (26), and is provided on its outside face with a portion (27) projecting in relation to the outside surface of the ring (2).

8. A tank (1) as claimed in claim 7, in which the ring (2) and the bottom wall (4) and top wall (9) are composed of a material selected from reinforced concrete and prestressed concrete, the leakproofing means comprising a lining (10) of the inside surface of the tank (1) with a material impervious to the fluid stored and compatible with said fluid.

9. A tank (1) as claimed in claim 1, in which the ring (2) and the bottom wall (4) and top wall (9) are made of steel, the leakproofing means comprising a lining (10) in the zone where the ring (2) and the bottom wall (4) meet and in the zone where the ring (2) and the top wall (9) meet.

10. A tank (1) as claimed in claim 1, in which the ring (2) and the bottom wall (4) and top wall (9) are composed of a material selected from reinforced concrete and prestressed concrete, the leakproofing means comprising a lining (10) of the inside surface of the tank (1) with a material impervious to the fluid stored and compatible with said fluid.

11. A tank (1) as claimed in claim 10, in which the leakproof lining (10) is made of metal and incorporates an expansion gusset (23) thereby ensuring the continuity of the lining and permitting relative movement of the lining in relation to said ring and said wall in the zone where the ring (2) and the top wall (9) meet.

12. A tank (1) as claimed in claim 11, in which the tie rods (8) are steel beams (15) whose ends are provided with embedded anchorage base plates (16).

13. A tank (1) as claimed in claim 11, in which the tie rods (8) are pillars of prestressed concrete.

14. A tank (1) as claimed in claim 10, in which the leakproof lining (10) is made of a material selected from the plastomers and the elastomers.

15. A tank (1) as claimed in claim 14, in which the tie rods (8) are pillars of prestressed concrete.

16. A tank (1) as claimed in claim 7, in which the tie rods (8) are steel beams (15) whose ends are provided with embedded anchorage base plates (16).

17. A tank (1) as claimed in claim 10, in which the tie rods are pillars of prestressed concrete.

18. A tank (1) as claimed in claim 1, in which the ring (2) and the bottom wall (4) and top wall (9) are made of steel, the leakproofing means comprising a lining (10) in the zone where the ring (2) and the bottom wall (4) meet and in the zone where the ring (2) and the top wall (9) meet.

19. A tank (1) as claimed in claim 1, in which the tie rods (8) are steel beams (15) whose ends are provided with anchorage base plates (16).

20. The tank (1) as claimed in claim 1 wherein said ring is capable of slight movement with respect to the structure comprised of said bottom wall, said top wall and said tie rods.

* * * * *

UNITED STATES PATENT AND TRADEMARK OFFICE

CERTIFICATE OF CORRECTION

PATENT NO. : 4,869,033

DATED : September 26, 1989

INVENTOR(S) : Jean-Claude Duvieusart et al.

It is certified that error appears in the above-identified patent and that said Letters Patent is hereby corrected as shown below:

Change the Assignee from Compagnie D'Enterprises CFE, Brussels, Belgium to --Compagnie D'Entreprises CFE, and Foraky S.A., Brussels, Belgium--.

Signed and Sealed this

Ninth Day of July, 1991

*Attest:*

*Attesting Officer*

HARRY F. MANBECK, JR.

*Commissioner of Patents and Trademarks*